US008944582B2

(12) United States Patent
Yamaguchi

(10) Patent No.: US 8,944,582 B2
(45) Date of Patent: Feb. 3, 2015

(54) SHEET PROCESSING APPARATUS AND PRINTING APPARATUS

(75) Inventor: Yoshinori Yamaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 13/539,078

(22) Filed: Jun. 29, 2012

(65) Prior Publication Data

US 2013/0027486 A1 Jan. 31, 2013

(30) Foreign Application Priority Data

Jul. 29, 2011 (JP) ..... 2011-166766

(51) Int. Cl.
*B41J 2/01* (2006.01)
*B41J 11/00* (2006.01)

(52) U.S. Cl.
CPC ..... *B41J 11/002* (2013.01); *B41J 11/0015* (2013.01)
USPC ..... 347/102; 347/101

(58) Field of Classification Search
CPC ..... B41J 11/002; B41J 11/0015
USPC ..... 347/102, 101
See application file for complete search history.

(56) References Cited

U.S. PATENT DOCUMENTS 5,708,920 A * 1/1998 Ohnishi et al. ..... 399/69
5,835,835 A * 11/1998 Nishikawa et al. ..... 399/328
2004/0189773 A1* 9/2004 Masumi et al. ..... 347/102

FOREIGN PATENT DOCUMENTS

CN 101934643 A 1/2011
JP 2000-117960 A 4/2000
JP 2004-306589 A 11/2004
WO 2010/087181 A1 8/2010

* cited by examiner

*Primary Examiner* — Henok Legesse
(74) *Attorney, Agent, or Firm* — Canon USA, Inc., IP Division

(57) ABSTRACT

A sheet processing apparatus includes a heater, an irradiation unit, and a contact unit. The irradiation unit irradiates a sheet with heat rays from the heater to heat the sheet by radiant heat. The contact unit includes a member that heats a region of the sheet by coming into contact with the radiant heated sheet on a downstream side of the irradiation unit. A part of the heat rays output from the heater is radiated onto a part of a structure constituting the contact unit to raise a temperature of the member.

19 Claims, 6 Drawing Sheets

SHEET PROCESSING APPARATUS AND PRINTING APPARATUS

BACKGROUND OF THE INVENTION

1. Field of the Invention

The present invention relates to a sheet processing apparatus suitably adapted to an inkjet printing apparatus and enabling to apply heat to a sheet with high efficiency.

2. Description of the Related Art

Japanese Patent Application Laid-Open No. 2004-306589 discusses an inkjet printing apparatus including a heater for drying ink. In this apparatus, a sheet printed by the inkjet printing apparatus is irradiated with ultraviolet rays to cure light curing ink, and is subject to pressure contact and heat by a roller with a built-in heater to fix the ink in a short time.

In the apparatus configuration in Japanese Patent Application Laid-Open No. 2004-306589, heat is mainly transferred from a narrow line-shaped region in which the roller and a surface of the sheet come into contact with each other. Therefore, the transfer efficiency of heat energy of the heater is poor, so that a large output heater is needed to dry the sheet in a short time. In other words, the power consumption of the printing apparatus uselessly increases.

Further, a lot of time may be required to dry the ink, depending on a type of a used sheet or ink. In such a case, the apparatus in Japanese Patent Application Laid-Open No. 2004-306589 has a possibility in which the ink adhering onto the surface of the heating roller cannot be dried during one revolution and is re-transferred to the sheet.

Further, when the used sheet is a thin paper, a cloth, or plastics, which has low rigidity, the print quality may be decreased by generating fine crease or corrugation on the sheet due to heating.

SUMMARY OF THE INVENTION

The present invention is directed to realizing an apparatus and a method which have low power consumption by enhancing the heat transfer efficiency from the heater to the sheet more than in the past.

Further, the present invention is also directed to realizing the apparatus and the method which can prevent generation of stain on the sheet, or fine crease and corrugation.

According to an aspect of the present invention, a sheet processing apparatus includes a heater configured to output heat rays, an irradiation unit configured to irradiate a sheet with the heat rays from the heater to heat the sheet by radiant heat, and a contact unit having a member configured to heat a region of the sheet by coming into contact with the radiant heated sheet on a downstream side of the irradiation unit, wherein a part of the heat rays output from the heater is radiated onto apart of a structure constituting the contact unit to raise a temperature of the member.

According to the present invention, since drying by applying radiation heat from the heater to a sheet with non-contact is performed while combining the drying with the member, in which temperature is raised by the same heater, coming into contact with the sheet, the heat energy generated from the heater can be effectively applied to the sheet. As the result, a large amount of drying ability can be obtained by the restricted power consumption.

In this case, since the drying is proceeded by the non-contact heating at first and then performed by the contact heating, the stain by adhering of ink at the contact unit can be prevented. In addition, since the contacting heating is performed after the non-contact heating, the sheet is corrected at the contact unit even if the crease or the corrugation are generated by the non-contact heating, so that the sheet in which the crease or the corrugation are suppressed can be finally obtained.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

The sheet processing apparatus is suitably adapted to the inkjet printing apparatus. However, this application is only one example and the present invention can be widely applied to apparatuses performing heat treatment or drying treatment to a sheet, in various production apparatuses using the sheet.

The sheet used in the apparatus according to the present exemplary embodiment is assumed to be a sheet not having a receptive layer, such as a vinyl chloride layer enabling to repel moisture (hereinafter referred to as no receptive layer sheet). Further, the general used sheet having the receptive layer can be also used. The used ink is assumed to be the ink containing a lot of emulsion components. The emulsion components have characteristics in which, by heating on the sheet, moisture in the ink is vaporized, and then the ink is soften and forms film. By the ink forming film on the sheet, weatherability, water resistance, and wear resistance of images can be improved.

Figure 1:
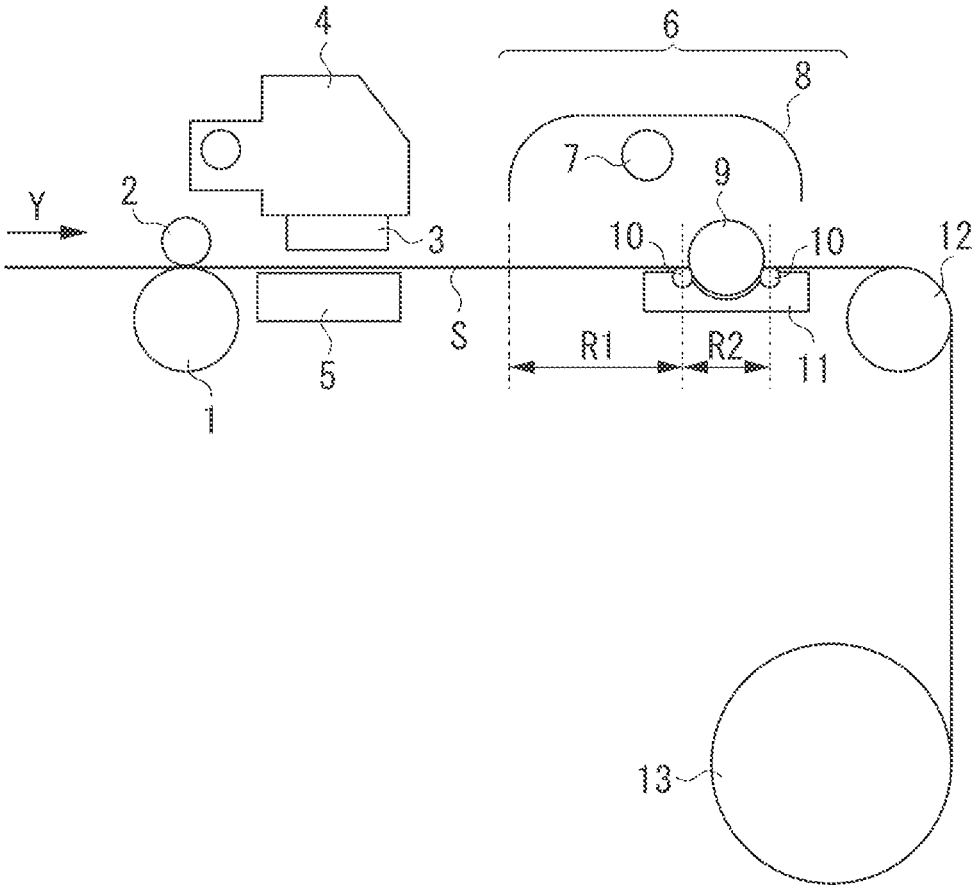
FIG. 1 is a cross-sectional view illustrating an entire configuration of an inkjet printing apparatus.

FIG. 1 is a cross-sectional view illustrating an entire configuration of an inkjet printing apparatus according to the present exemplary embodiment. The printing apparatus roughly includes a sheet conveyance unit, a printing unit, a drying unit, and a control unit. These units will be described in order as follows.

A recording medium used in the present exemplary embodiment is a roll sheet in which a long continuous sheet is wound in a roll shape. The roll is set in a sheet feeding unit not illustrated and a sheet S pulled out from the roll is supplied from the arrow direction Y to the printing unit. The supplied sheet S is nipped by a roller pair constituted with a conveyance roller 1, which is responsible for conveying the sheet in printing, and a pinch roller 2, and sheet conveyance is performed by roller rotation. A conveyance roller 12 (turn roller) is also provided on the downstream side of the sheet conveyance direction and the processed sheet S is finally wound by a winding unit 13 in a roll shape.

The printing unit mainly includes a print head 3, a carriage 4, and a platen 5. The sheet S moves on the platen 5 and printing is performed by applying ink from the print head 3 onto the sheet.

The print head 3 includes a nozzle for discharging ink by the inkjet method. As an energy generation element for discharging ink, various elements, such as, a heating element, a piezoelectric element, an electrostatic element, and a micro-electro-mechanical systems (MEMS) element have been known. In this exemplary embodiment, any elements can be used.

The print head 3 is mounted on the carriage 4. The carriage 4 reciprocates above the platen 5, in the X direction (the vertical direction of the sheet surface in FIG. 1), which crosses (intersects perpendicularly) the Y direction, in which the sheet S is conveyed. In the print unit, one image is formed by a serial printing method in which a main scanning and a sub scanning are alternately repeated. The main scanning is an operation discharging ink from the print head 3 while moving the carriage 4, and the sub scanning is an operation step-sending the sheet. In addition, the printing method is not limited to the serial printing method. A line printing method can be used. In the line printing method, printing is performed, using a full-line head as the print head 3 while continuously sending the sheet.

In the sheet conveyance direction (Y direction), the drying unit 6 is provided on the downstream side of the print unit 6. The drying unit 6 applies heat for drying the ink applied on the sheet in a short time. Since the drying unit 6 is a main feature of the present exemplary embodiment, it will be described in detail.

The drying unit 6 includes a heater 7 as a heat source. The heater 7 converts electric energy to heat energy mainly including heat rays from infrared rays to far-infrared rays. The heater 7 is a rod-shaped heating element prolonged in the width direction of the sheet S (the vertical direction of the sheet surface in FIG. 1).

The drying unit 6 includes a first region R1 and a second region R2 along the sheet conveying direction (Y direction). The first region R1 performs non-contact sheet heating. The second region R2 performs contact sheet heating in the downstream side of the first region R1. In the first region R1, heating is performed by an irradiation unit irradiating a sheet with heat ray of the heater 7. In the second region R2, heating is performed by a contact unit applying heat to the sheet with a temperature-raised member coming into contact with the sheet. As described below, a part of the structure constituting the contact unit is irradiated with a part of the heat rays of the heater 7 (radiant heat) and raises temperature of the member coming into contact with the sheet. In other words, the heater 7 is a shared heat supplying source of the irradiation unit and the contact unit.

The irradiation unit includes the heater 7 and a reflector 8 including a heat reflection surface (a mirror surface) reflecting heat rays emitted from the heater 7. The reflection surface has a shape in which the heat rays reflected by the reflector 8 are directed to the first region R1 and the second region R2.

The contact unit has a structure including a heating roller 9, two assist rollers 10, and a roller guide 11. The heating roller 9 comes into contact with the surface of the sheet S (an ink -applied surface) and applies heat to the sheet. In the roller guide 11, a guide surface having a concave shaped cylindrical curved surface is formed. The curvature of the cylindrical curved surface is a little larger than the curvature of the outer periphery of the heating roller 9, and has an almost the same curvature as that of the outer periphery of the heating roller 9.

In the contact unit, the sheet S advances while having a state in which the sheet S is nipped between a part of the down side of the outer periphery surface of the heating roller 9 and the guide surface of the roller guide 11. In other words, in the contact unit, the heating roller 9 comes into contact with the printed surface of the sheet S and presses downward, and the sheet S becomes a partially curved shape along the outer periphery of the heating roller 9 and is conveyed. The two assist rollers 10 prevent the conveyed sheet from forming excessive creases and scratches. By the switching mechanism described below, the heating roller 9 can advance/retreat to positions of a plurality of steps with respect to the guide surface of the roller guide 11. By advancing/retreating, the state is switched to a first state in which the heating roller 9 presses the sheet and a second state in which the heating roller 9 does not press the sheet.

In addition, the heating roller 9 rotates for smoothening the conveying of the sheet, but it may be a member which is fixed without rotating if the surface friction is small. Further, the roller guide 11 may be one or a plurality of driven rollers which comes into contact with the heating roller 9, or the roller guide 11 itself may be omitted.

In the drying unit 6, the heat rays (radiant heat) from the heater 7 is directly radiated to the printed surface of the sheet S in the first region R1. In the following second region R2, a part of the heat rays from the heater 7 directly is radiated from an upper side to the heating roller 9, which is a part of the structure constituting the heating unit, so that the temperature of the heating roller 9 rises. Since the heating roller 9 rotates at a time of conveying the sheet S, the temperature of the entire surface of the heating roller 9 uniformly rises. The temperature-raised heating roller 9 comes into contact with the sheet S to heat the sheet S. The heating roller 9 is made of a member having a high heat transfer rate and a large heat capacity.

The reason of making the first region R1 to be an upstream and the second region R2 to be a downstream along the sheet conveyance direction is that the ink on the sheet immediately after printed in the print unit has not been dried. More specifically, when a sheet comes into contact with something, such as a roller, in the state in which the sheet is wet with ink, the ink adheres to the something with which the sheet comes into contact. Therefore, drying of the ink is accelerated by non-contact heating in the first region R1, and then the heating roller 9 comes into contact with the sheet to heat more in the second region R2. The reason of performing the contact heating in the second region R2 is, by pressing the sheet to the surface of the heating roller 9 which is high temperature, to correct fine creases and corrugation which can be generated by the non-contact heating in the first region R1. Particularly, when the sheet is thin papers, clothes, or plastics, which has low rigidity, a large effect can be obtained, so that the final printing quality is improved.

Figure 2A:
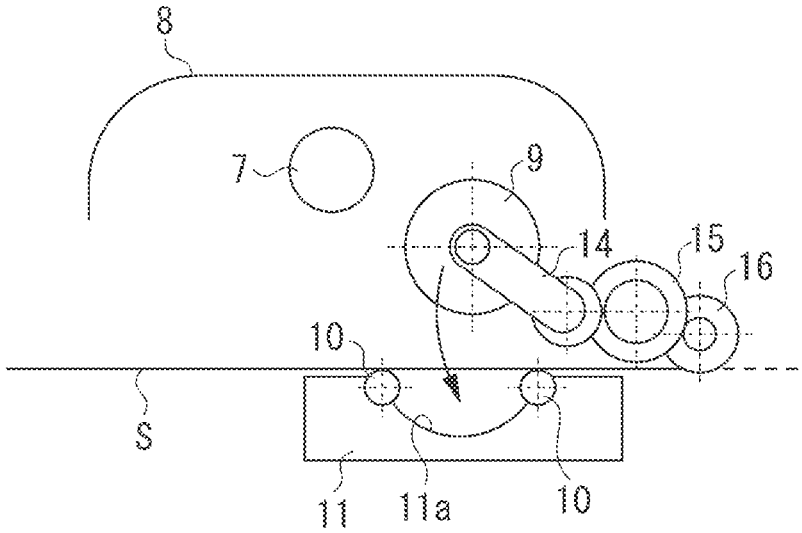
FIGS. 2A, 2B, and 2C are cross-sectional views illustrating operation states of advancing/retreating of a heating roller.
Figure 2B:
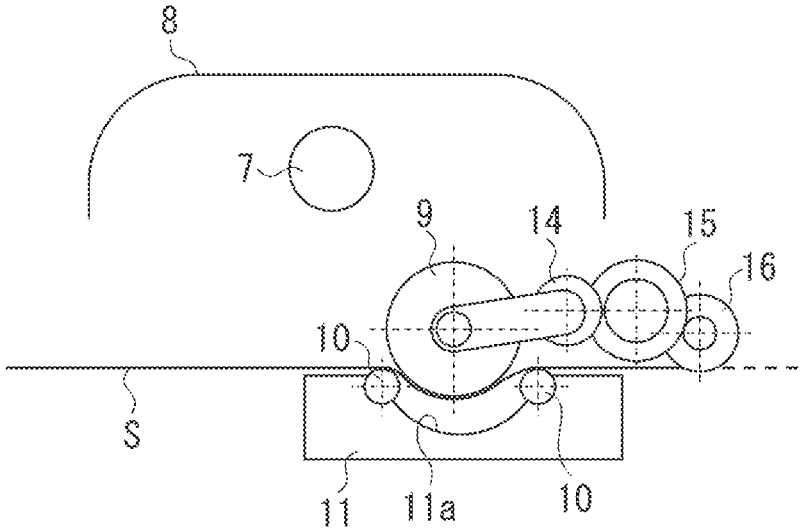
Figure 2C:
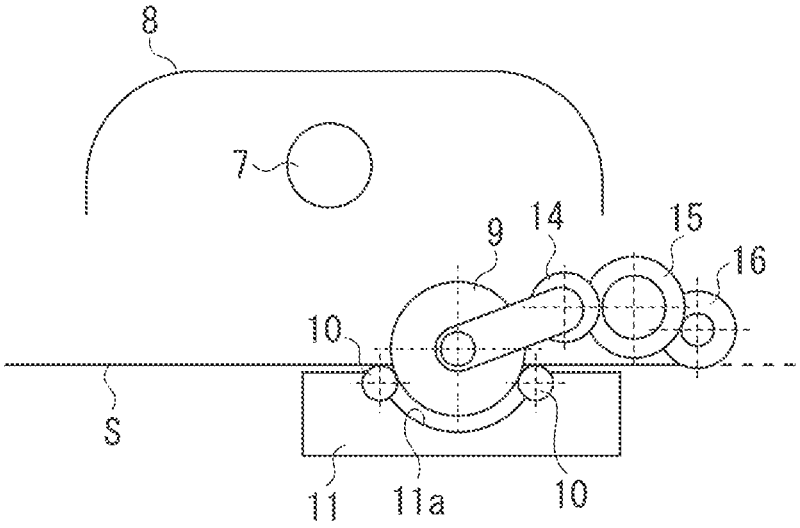

FIGS. 2A to 2C are the cross-sectional views illustrating operation states of advancing/retreating of the heating roller 9. FIG. 2A is the state in which the heating roller 9 retreats most from the guide surface 11*a* of the roller guide 11 (the second state). The outer periphery of the heating roller 9 is separated from the sheet S. FIG. 2B is the state in which the heating roller 9 closes to the guide surface 11*a* of the roller guide 11. A part of the outer periphery of the heating roller 9 comes into contact with the sheet S and slightly presses down the sheet S. FIG. 2C is the state in which the heating roller 9 gets closer most to the guide surface 11*a* of the roller guide 11 (the first state). A part of the outer periphery of the heating roller 9 comes into contact with the sheet S with larger area and presses down the sheet S to the lowest position. At this time, the contact area between the heating roller 9 and the sheet S is larger than the contact area in the state in FIG. 2B. The sheet S passes a slight clearance having a circular shape in cross section between the heating roller 9 and the guide surface 11*a*. Accordingly, in the drying unit 6, the contact area between the heating roller 9 and the sheet S can be changed in a plurality of steps.

Accordingly, the switching mechanism for advancing/retreating the heating roller 9 includes an arm 14 rotatably supporting the both ends of the heating roller 9, a gear train 15 connected to the arm 14, and a motor 16 connected to the gear train 15. Rotation of the motor 16 rotates and moves the arm 14 via the gear train 15 to move the heating roller 9 up and down.

By controlling an amount of rotation of the motor 16, a position of the heating roller 9, i.e., urging force from the heating roller 9 to the sheet S in the contact unit, can be arbitrarily set. In this exemplary embodiment, the heating roller 9 can be selectively positioned at the three positions, i.e., the state in FIG. 2A in which the urging force is zero, the state in FIG. 2B in which the urging force is small, and the state in FIG. 2C in which the urging force is large.

For example, according to types of the used sheet or printing conditions (the pass number of multi-pass), the most proper position is set. Table 1 illustrates the examples of combinations of the setting conditions of the temperature of the heating roller 9 and the urging force of the heating roller 9 according to the conditions.

TABLE 1

| | | Setting conditions | | |
|---|---|---|---|---|
| Types of sheet | Pass numbers | Roller temperature | Roller pressure | Amount of urging force |
| A | 4 | 70° C. | with pressure | large |
| | 8 | 70° C. | without pressure | zero |
| B | 6 | 90° C. | with pressure | large |
| | 12 | 90° C. | with pressure | small |
| C | 4 | 80° C. | with pressure | small |
| | 8 | 90° C. | without pressure | zero |

Figure 3:
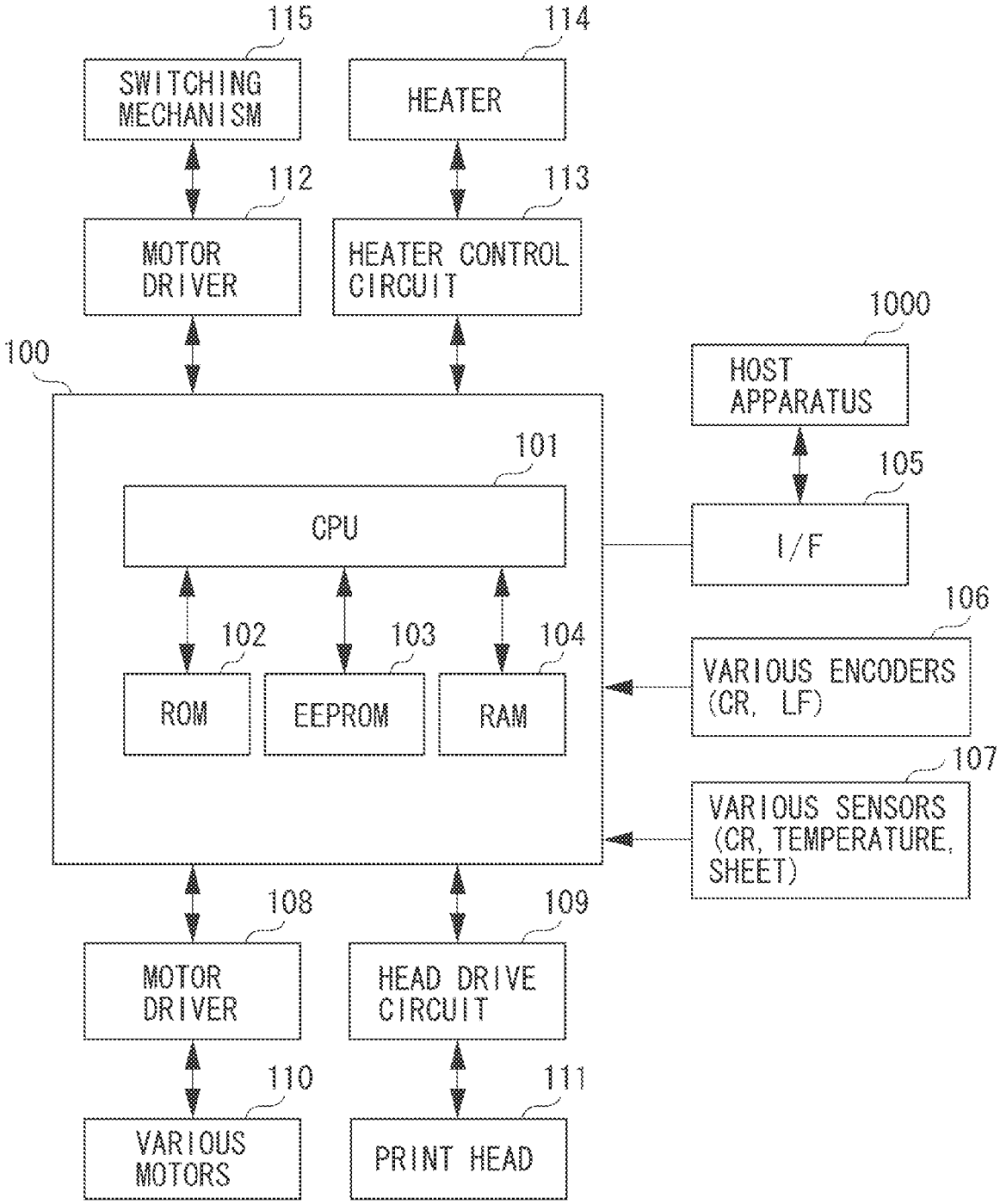
FIG. 3 is a system block diagram of a control unit.

FIG. 3 is a system block diagram of the control unit controlling the printing apparatus. A controller 100 is a core of the control unit and includes a central processing unit (CPU) 101, a read-only memory (ROM) 102, an electrically erasable and programmable read-only memory (EEPROM) 103, and a random access memory (RAM) 104. An input/output (I/O) interface 105 connects an external host apparatus 1000 to the controller 100 and allows two-way communication based on the predetermined protocol. Various encoders 106 detect a position of a carriage in the main scanning direction and rotations of the conveyance rollers. In various sensors 107, there are a seat sensor mounted on the carriage, a temperature sensor, and a sensor detecting a sheet's leading edge.

By instructions from the controller 100, operations of the various motors in the printing apparatus are controlled via motor drivers 108 and a print head 1111 (the print head 3 in FIG. 1) is driven via a head drive circuit 109. By instructions from the controller 100, a switching mechanism 115 (the motor 16 in FIGS. 2A to 2C) is controlled via the motor driver 112. Furthermore, by instructions from the controller 100, a heater 114 (the heater 7 in FIG. 1) is controlled via a heater control circuit 113.

Figure 4:
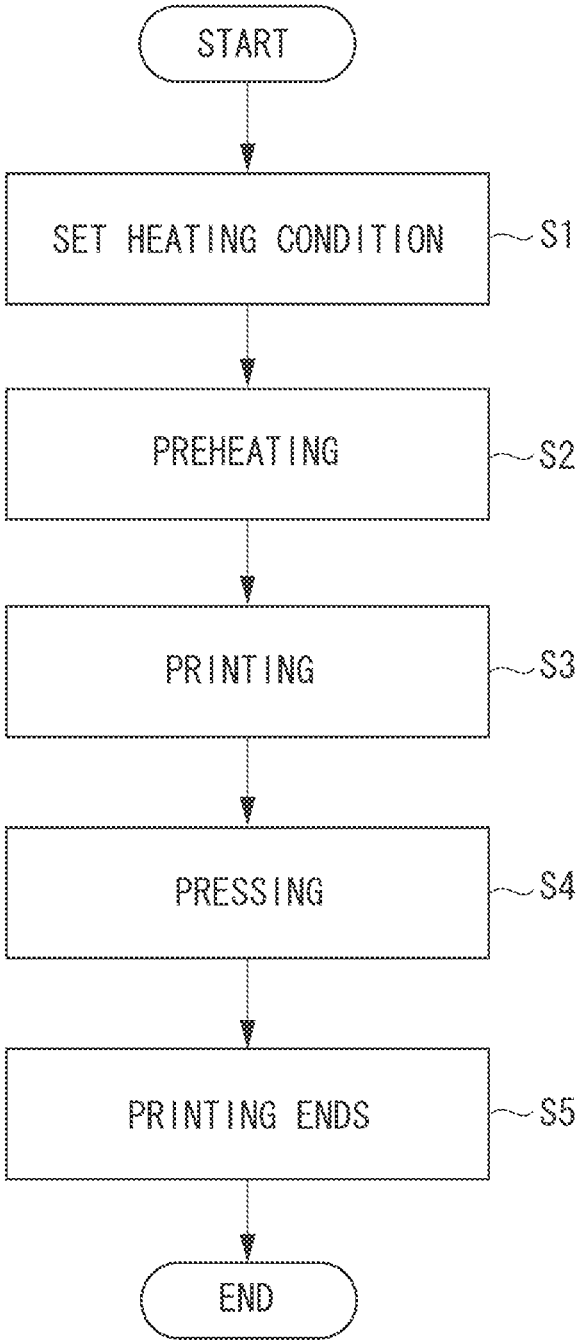
FIG. 4 is a flowchart illustrating a printing operation sequence.

FIG. 4 is a flowchart illustrating a print operation sequence performed by control of the control unit.

In step S1 (set heating condition), the controller 100 instructs to set a heating condition and other print conditions (the pass number of multi-pass printing) from information of types of sheets, which are designated by a user or automatically recognized by the printing apparatus, and printing mode (print quality). Above Table 1 is a data table for condition setting. The data table is stored in the memory in the control unit. The control unit refers to the data table based on the kinds of sheet to be used and the pass numbers, and acquires the optimal roller temperature, presence or absence of roller pressing, and an amount of urging force.

In step S2 (pre-heating), before starting printing operation, the controller 100 instructs to pre-heat the heater so as to apply the heat by which both the first region R1 and the second region R2 can reach a target temperature.

In step S3 (printing), the control unit instructs to start printing operation in the printing unit. Then, the processing proceeds to step S4 but the printing operation is also continued after that.

In step S4 (pressing), the control unit instructs to drive the switching circuit to move the heating roller 9 to the position in which the amount of urging force becomes to be a value set in step S1. The heating roller 9 for the conveyed sheet is pressed to the sheet to press and heat. Since the heating roller 9 is pressed after the start of the printing operation, damage hardly occurs in the sheet. In the printing operation, heating and drying is performed in non-contact state in the first region R1 and heating and drying is performed in contact state in the following second region R2.

In step S5 (end of printing), after the printing of the images intended to print in the printing unit is finished, the control unit instructs to end the heating operation in the drying unit. The control unit instructs to drive the switching mechanism and retreat the heating roller 9 above. Then, the series of operations is ended.

Figure 5A:
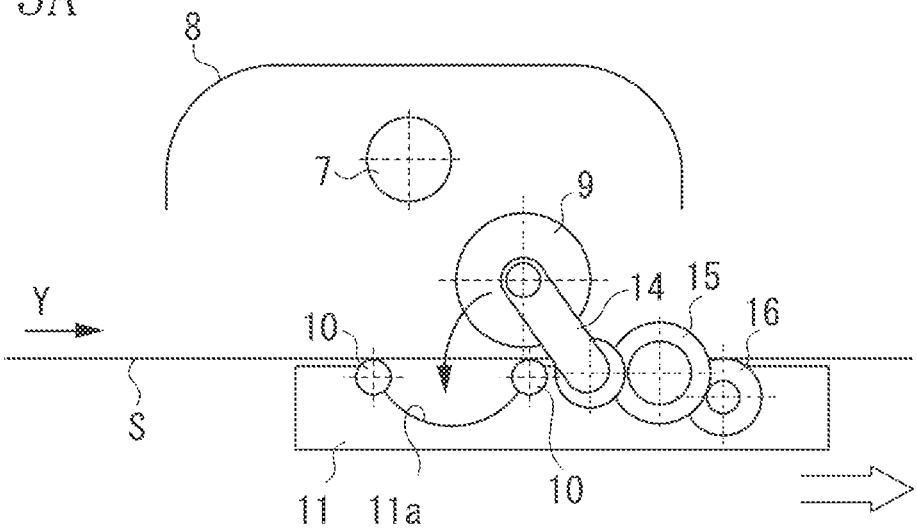
FIGS. 5A and 5B are cross-sectional views illustrating another exemplary embodiment of a drying unit.
Figure 5B:
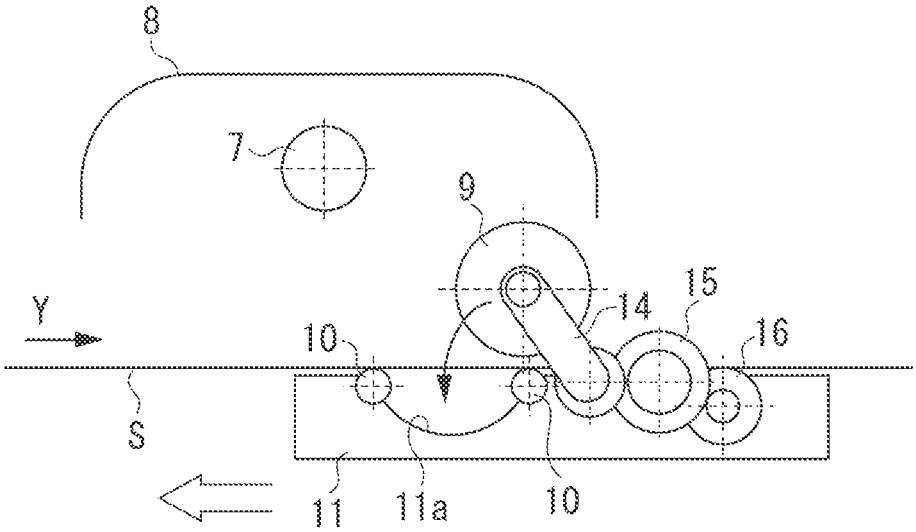

FIG. 5 is a cross-sectional view illustrating another exemplary embodiment of the drying unit. The same numerals as the above FIGS. 2A to 2C indicate the same or equivalent members. The contact unit can be moved by a rack mechanism in the predetermined range along the sheet conveyance direction (in the arrow direction). With this structure, the distance from the heater 7 to the heating roller 9 can be arbitrarily changed, so that the amount of the radiant heat applied from the heater 7 to the heating roller 9 can be adjusted. In a state in FIG. 5A, the heating roller 9 is closer to the heater 7 as compared with the state in FIG. 5B, so that the surface temperature of the heating roller 9 becomes higher. In this exemplary embodiment, the temperature of the heating roller 9 can be adjusted to the predetermined temperature by moving the contact unit, while setting the heater temperature to be constant.

According to the above exemplary embodiments, since both the drying by applying radiant heat from the heater to the sheet in non-contact state and the drying by the member in which temperature is raised by the heat from the same heater coming into contact with the sheet are performed collectively, the heat energy generated by the heater can be efficiently applied to the sheet. As the result, a large amount of drying ability can be obtained in the restricted power consumption. At this time, since the drying proceeds by non-contact heating at first and then heating is performed by contact heating, the contact unit can be prevented from being stained by ink adhering. In addition, after the non-contact heating, the contact heating is performed, so that even when the creases and corrugations are generated in a sheet, the sheet is corrected in the contact unit and the sheet without ceases and corrugations can be finally obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-166766 filed Jul. 29, 2011, which is hereby incorporated by reference herein in its entirety.

What is claimed is:

1. A sheet processing apparatus comprising:

an irradiation unit having a heater configured to output heat rays to heat a sheet in a first sheet conveyance region to form a radiant heated sheet; and a contact unit having a member configured to heat the radiant heated sheet in a second sheet conveyance region by coming into contact with the radiant heated sheet on a downstream side of the first sheet conveyance region, wherein the irradiation unit further includes a reflector having a heat reflection surface configured to reflect heat rays emitted from the heater directly onto the sheet to heat the sheet by radiant heat and configured to simultaneously reflect heat rays emitted from the heater directly onto a part of the structure constituting the contact unit to raise a temperature of the member to additionally heat the radiant heated sheet through the member, wherein the heat reflection surface is position directly above the heater and the member such that a top of the member receives heat rays reflected from the heat reflection surface.

2. The sheet processing according to claim 1, wherein the member includes a roller, and wherein the radiant heated sheet is conveyed while wrapped around a part of the roller.

3. The sheet processing apparatus according to claim 2, wherein the contact unit is configured to change a contact area between the roller and the radiant heated sheet in a plurality of steps.

4. The sheet processing apparatus according to claim 2, wherein the contact unit includes a mechanism to switch between a first state to press the radiant heated sheet by the roller and a second state not to press the radiant heated sheet by the roller.

5. The sheet processing apparatus according to claim 4, further comprising a control unit configured to control to switch the first state and the second state according to a type of a sheet to be used.

6. The sheet processing apparatus according to claim 4, further comprising a control unit configured to control to switch the first state and the second state according to printing condition information, received in the sheet processing apparatus, about a pass number through a printing unit of multi-pass printing by the printing unit.

7. The sheet processing apparatus according to claim 1, further comprising a mechanism to move the contact unit along a sheet conveyance direction.

8. The sheet processing apparatus according to claim 1, wherein the heater converts electric energy to heat energy mainly including heat rays from infrared rays to far-infrared rays.

9. The sheet processing apparatus according to claim 8, wherein the heater is a rod-shaped heating element prolonged in the width direction of the sheet.

10. The sheet processing apparatus according to claim 1, wherein the heater is configured to be a heat supplying source of the contact unit and the radiant heated sheet.

11. The sheet processing apparatus according to claim 1, wherein the irradiation unit directs a part of the heat rays output from the heater onto the contact unit to raise a temperature of the member.

12. The sheet processing apparatus according to claim 1, wherein the heat reflection surface has a shape in which the heat rays reflected by the reflector are directed onto the part of the structure constituting the contact unit to raise a temperature of the member to additionally heat the radiant heated sheet through the member.

13. The sheet processing apparatus according to claim 1, wherein the heater is located upstream of the contact unit at a position that accelerates drying of ink on the sheet by non-contact heating.

14. The sheet processing apparatus according to claim 1, wherein the heat reflection surface position directly above the heater extends over where the sheet, heated by both the irradiation unit and contact unit, is conveyed, and then extends downward at two ends of the heat reflection surface towards where the sheet is conveyed.

15. The sheet processing apparatus according to claim 1, further comprising a roller guide that includes a guide surface having a concave shaped cylindrical curved surface, wherein the contact made by the contact unit to the sheet heats the sheet as the sheet follows along concave shaped cylindrical curved surface such that fine creases and corrugation generated in the sheet by non-contact heating from the irradiation unit are corrected.

16. The sheet processing apparatus according to claim 1, wherein the member is a roller and wherein the part of the heat rays output from the heater directed onto the part of the structure constituting the contact unit is radiated from the heat reflection surface above an upper side of the roller directly to the roller as the roller rotates so that the top of the roller receives heat rays reflected from the heat reflection surface and the temperature of an entire surface of the roller uniformly rises.

17. A sheet processing method for a sheet processing apparatus, the sheet processing method comprising:

outputting, via an irradiation unit having a heater, heat rays to heat a sheet in a first sheet conveyance region to form a radiant heated sheet; and heating, via a contact unit having a member, the radiant heated sheet in a second sheet conveyance region by coming into contact with the radiant heated sheet on a downstream side of the first sheet conveyance region, wherein the irradiation unit further includes a reflector having a heat reflection surface that reflects heat rays emitted from the heater directly onto the sheet to heat the sheet by radiant heat and simultaneously reflects heat rays emitted from the heater directly onto a part of the structure constituting the contact unit to raise a temperature of the member to additionally heat the radiant heated sheet through the member, wherein the heat reflection surface is position directly above the heater and the member such that a top of the member receives heat rays reflected from the heat reflection surface.

18. A printing apparatus comprising:

a printing unit configured to print on a sheet by an inkjet method; and a sheet processing apparatus having:

an irradiation unit having a heater configured to output heat rays to heat the sheet in a first sheet conveyance region to form a radiant heated sheet, and a contact unit having a member configured to heat the radiant heated sheet in a second sheet conveyance region by coming into contact with the radiant heated sheet on a downstream side of the first sheet conveyance region, wherein the irradiation unit further includes a reflector having a heat reflection surface configured to reflect heat rays emitted from the heater directly onto the sheet to heat the sheet by radiant heat and configured to simultaneously reflect heat rays emitted from the heater directly onto a part of the structure constituting the contact unit to raise a temperature of the member to additionally heat the radiant heated sheet through the member, wherein the heat reflection surface is position directly above the heater and the member such that a top of the member receives heat rays reflected from the heat reflection surface.

19. The printing apparatus according to claim 18, wherein the sheet is a no-receptive layer sheet that does not include a receptive layer of ink, and wherein the ink includes an emulsion component.

* * * * *